US005207735A

United States Patent [19]

Furmanski

[11] Patent Number: 5,207,735

[45] Date of Patent: May 4, 1993

[54] METHOD AND APPARATUS FOR RECLAIMING TOBACCO FROM REJECTED CIGARETTES

[75] Inventor: Horst Furmanski, Berlin, Fed. Rep. of Germany

[73] Assignee: Fabriques de Tabac Reunies, S.A., Neuchatel, Switzerland

[21] Appl. No.: 760,493

[22] Filed: Sep. 16, 1991

[30] Foreign Application Priority Data

Sep. 14, 1990 [DE] Fed. Rep. of Germany ..... 4029263

[51] Int. Cl.[5] ..... A24C 5/36

[52] U.S. Cl. ..... 131/96

[58] Field of Search ..... 131/96

[56] References Cited

U.S. PATENT DOCUMENTS 3,757,799 9/1973 DiIanni et al. .

4,117,852 10/1978 Newman et al. ..... 131/96

FOREIGN PATENT DOCUMENTS 0192372 3/1989 European Pat. Off. .

1121522 8/1962 Fed. Rep. of Germany .

*Primary Examiner*—V. Millin

*Assistant Examiner*—J. Doyle

*Attorney, Agent, or Firm*—Jeffrey H. Ingerman

[57] ABSTRACT

Apparatus for reclaiming tobacco from rejected cigarettes is provided. A receiving drum having holes to receive the rejected cigarettes is provided coaxial with a fluted drum, so that both drums rotate in the same direction. Via a control ring turning in synchronization with the receiving drum, jets of compressed air eject the tobacco from the rejected cigarettes, before the empty cigarette wrapper (tube) is also expelled from the receiving hole. A timing disk controls the work cycle. Suction pressure applied to the receiving holes of the receiving drum sucks the rejected cigarette into a predetermined stop position in the receiving hole prior to the application of compressed air. With the aid of restraining needles, the cigarettes are held firmly while the jet of compressed air is applied to expel the tobacco. On release by the restraining needles, the cigarette wrapper (tube) is ejected from the receiving hole to a discharge chute by a jet of compressed air applied via the control ring. A method for operating the apparatus is also provided.

20 Claims, 5 Drawing Sheets

METHOD AND APPARATUS FOR RECLAIMING TOBACCO FROM REJECTED CIGARETTES

BACKGROUND OF THE INVENTION

The invention relates to an apparatus and a method for reclaiming tobacco from rejected cigarettes.

From European Patent Specification 0 192 372, a method and an apparatus for ejecting tobacco from filter cigarettes is known. This apparatus features a hopper for rejected cigarettes, a cigarette transport means comprising a fluted drum turning about its center axis and having a plurality of fluted depressions regularly distributed about its periphery, means for restraining single cigarettes, means for supplying a jet of compressed air, collector means for receiving the ejected tobacco and separate collector means for receiving the cigarette wrappers (tubes) and means for coordinating movements of the means of the apparatus. With the aid of these means, the filter cigarettes arriving from the hopper are transported singly to the fluted drum which transports them further by rotating. By means of a movable block having adapters suitable to grip the filter tips of the cigarettes, at least one cigarette located on the periphery of the fluted drum is gripped. Compressed air is blown through the filter cigarette so that the tobacco is ejected from the cigarette tube and transported to corresponding tobacco collector means. The cigarette tubes and the associated filter tips, together with the filter, are transported by the advancement of the fluted drum to a corresponding further collector means. With this apparatus and its method of operation, difficulties are experienced in coordinating the movements of the various means and gripping the rejected cigarettes, due to the longitudinal travel movements and rotary movements of the fluted drum and adapters. In addition, the working capacity of this apparatus is not satisfactory for many applications.

From U.S. Pat. No. 3,757,799 further devices for reclaiming tobacco from rejected cigarettes are known. In the apparatus according to U.S. Pat. No. 3,757,799 at least one further fluted drum is provided, and arranged to run in parallel at some distance away from the center-axis of the first drum. This second fluted drum turns in the opposite direction to that of the first such drum. Coordination of the two drums turning in opposing directions enables the cigarettes to be held at specific locations so that the tobacco can be ejected by means of a jet of compressed air. A third such drum can be provided which impinges the filter cigarettes with compressed air to loosen the tobacco filler. In German patent 11 21 522, the apparatus also comprises two drums turning in opposite directions, which are located with their axes parallel and which are fluted on the periphery so that each flute receives a single cigarette. Means are also provided for directing a jet of air against the tobacco in the cigarette. A drum can be provided which coordinates with the flutes of the drum in succession with rotary drum movement so that the compressed air can be directed by tubing into the tobacco of each cigarette as indexed. These tubes can have the form of hollow needles which can be shifted against the cigarette tube at right angles to the center-line of the cigarettes in the flutes so that these needles also constitute means for restraining the cigarettes. The cigarette tubes, the tobacco, and any filter tips provided, are collected in separate containers.

SUMMARY OF THE INVENTION

An object of the invention is to provide an apparatus and a method for reclaiming the tobacco of rejected cigarettes while overcoming the aforementioned difficulties and permitting speedy and reliable separation of cigarette tubes, the filter tip—where provided—and the tobacco all in an automated operation.

According to the invention there is provided in an apparatus for reclaiming tobacco from rejected cigarettes comprising:

a) a hopper for receiving the rejected cigarettes, b) means for transporting the cigarettes, comprising a fluted drum having two tubes and a periphery, turning about its center axis, the drum having a plurality of fluted depressions regularly distributed about the periphery, each fluted depression accommodating a single cigarette, c) means for restraining single cigarettes, d) means for supplying a jet of compressed air to expel the tobacco from each restrained cigarette, e) a collector means for receiving the ejected tobacco and another collector means to receive the cigarette wrappers, and f) means for coordinating movements of the apparatus, the improvement comprising:

g) a receiving drum having receiving holes axially aligned with the flutes in the fluted drum, the receiving drum having a front face and a rear face, the front face facing the fluted drum and the rear face facing away from the fluted drum, the receiving drum coupled to the fluted drum so that the drums rotate together about the center axis, h) suction means for transferring a cigarette from the fluted drum into the corresponding receiving hole so that the filter tip of the cigarette is positioned in an arm of the receiving hole near the rear face of the receiving drum, i) the restraining means including at least one restraining needle per receiving hole, the needle being radially moveable so that the needle can move into engagement with the filter tip of the cigarette in the receiving hole, j) the coordinating control means comprising a control ring arranged in an axial extension of the receiving drum, the ring being divided into predetermined angular zones for determining the working sequence of the apparatus.

In an apparatus according to the invention, a fluted drum is provided for transporting single cigarettes. The fluted drum is connected to a receiving drum as an axial extension and free to turn in the same direction, the receiving drum having receiving holes into which single cigarettes can be fully accommodated from the fluted drum. After the cigarette is restrained, the tobacco can be expelled from the wrapper (tube) by means of a jet of compressed air and, following release by the restraining means, the wrapper can be expelled together with its filter tip from the receiving hole by another jet of compressed air and can be transported to an assigned collecting and receiving means. This arrangement of fluted drum and receiving drum forms a single turning unit, which in conjunction with the coordinating control means comprising the control ring, permits the tobacco to be expelled from each restrained cigarette in a predetermined working cycle, during one complete rotation of this unit. The moving means of the apparatus ensure smooth cooperation due to the fluted drum, the receiving drum and the control ring of the coordinating control means running in synchronism. Thus, tobacco can be speedily and reliably reclaimed from rejected cigarettes during a single rotation of the two drum unit. By means of the apparatus according to the invention high ejection capacity is achieved during continuous rotation of the two drum unit.

Preferably, each receiving hole in the receiving drum is assigned two axially spaced restraining needles to hold the cigarette in place so that relatively high expelling pressures can be used to improve working capacity.

Preferably, a guide ring is provided for guiding the restraining needles into a restraining position. The guide ring surrounds and is firmly coupled to the receiving drum. The restraining needles are free to move radially within the guide ring. Roller pins, coupled to the restraining needles, provide means for urging the needles into engagement with the filter tips. In conjunction with a cam control, the roller pins engage the restraining needles and shift the needles into a restraining position. The restraining needles remain in their restraining position by means of the cam for at least the duration of expelling the tobacco from the cigarettes. This design provides means for restraining which can be operated while the two drums are turning, so that controlling the operation of the restraining means is possible during turning without any coordination difficulties.

Preferably the control ring of the apparatus according to the invention is spring-mounted in the axial direction of the receiving drum so that it is in contact with the rear face of the receiving drum and serves as stop means to determine the insertion depth of the cigarettes in the receiving holes. In this arrangement, the control ring is formed as a kind of slip ring which is continually held in contact with the rear face of the receiving drum to prevent it from lifting away from the drum due to alternating high and low pressures. At the same time, the control ring in this embodiment serves as the stop means ensuring that the cigarettes, together with any filter tips and irrespective of their length, are always located sufficiently deep in the receiving holes so that the restraining means are able to reliably hold each cigarette.

In accordance with one preferred embodiment of the invention, the control ring passes through at least one predetermined angular zone, which acts as the control zone for application of a vacuum pressure to suck the cigarettes into the receiving holes, and one angular zone which acts as the control zone to introduce the compressed air necessary for ejecting the tobacco from the wrappers (tubes) of the cigarettes in the receiving holes, during one complete revolution of the two drums. In these angular zones acting as control zones, openings are preferably provided through which a connection can be made to a compressed air source or a suction pressure generating unit. By means of the corresponding size of the openings, as measured in the angular direction, the time during which a suction pressure or forced pressure acts on the cigarettes in the receiving holes can then be determined in conjunction with the rotary speed of the two drums. Control of the operating sequence to be carried out by the apparatus is provided by coordinating control means active during rotation that directly control all movements of the apparatus during rotation.

Preferably, the control ring comprises a further angular zone as a control zone at which compressed air is introduced to eject the empty cigarette wrappers (tubes)—which may also feature filter tips—from the receiving holes. This further angular zone preferably follows the control zone during which the tobacco is ejected from the wrappers by jets of compressed air.

In accordance with another preferred embodiment of the invention, the coordinating control means also comprise a timing disc to determine the phasing of operation. The timing disc is arranged axially spaced from the control ring and controls the further control means of the apparatus. With the aid of the timing disc, the various means of the overall apparatus can be coordinated in a specific way.

In one particularly preferred embodiment, the fluted drum and the receiving drum are located on a common spindle, on which the control ring and the timing disc may also be mounted. If a spindle of this kind is provided, synchronization of the two drums, the control ring, and the timing disc is assured, thus improving reliability.

To ensure a reliable transfer of the cigarettes from the flutes of the fluted drum to the receiving holes in the receiving drum, suitable guide tapers are provided at the interface between the corresponding flutes of the fluted drum and the receiving holes in the receiving drum. This ensures that each cigarette is reliably sucked into the corresponding receiving hole even in the presence of slight lack of alignment due to limitations in machining tolerances.

To assist handling of the individual rejected cigarettes by the fluted drum, a many-cornered deflector roller may preferably be set to turn in the same direction as the fluted drum on a parallel axis, so that the apparatus can be operated at a high working speed.

To achieve a compact design of the apparatus, the fluted drum, the interconnected receiving drum and the many-cornered deflector roller may be powered by a common driving means.

Preferably the apparatus is suitable for use with filter cigarettes, i.e., cigarettes having a filter tip.

In accordance with another useful embodiment of the invention, a sensor is provided to monitor cigarette insertion into the receiving holes of the receiving drum, which halts operation of the apparatus when a cigarette is missing in the receiving hole. Furthermore, the apparatus can preferably feature photoelectric-type sensing means to detect and count the cigarettes from which tobacco is to be ejected.

A method of operating the apparatus for reclaiming tobacco from rejected cigarettes is characterized by the following operating sequence which is substantially achieved with the aid of the coordinating control means:

with the aid of the many-cornered deflector roller the filter cigarettes arriving from the hopper are introduced singly into the corresponding flutes of the fluted drum;

rotary movement of the fluted drum causes the filter cigarettes to be transported further in the peripheral direction;

the filter cigarettes in the flutes of the fluted drum are axially transferred into the receiving holes of the receiving drum and by means of suction pressure or forced pressure applied via the control ring of the coordinating control means, they are drawn into the receiving holes until their filter tips are in contact with the control ring;

the pressure pins on the guide ring are impinged via a corresponding cam segment so that the restraining needles of the restraining means hold the cigarettes preferably by the filter tip in the receiving holes;

forced pressure or blowing pressure is applied as controlled by the control ring, by means of which the tobacco is ejected from the cigarette wrapper (tube) and transported to the assigned collector for the tobacco;

the restraining needles of the restraining means are then retracted from the cigarette wrapper by the pressure pins on the guide ring being released by the cam segment, and by means of a further jet (pulse) of compressed air, as controlled by the control ring, the cigarette wrappers (tubes) are ejected from the receiving holes and transported into a suitable collector means for the same.

The method can also be arranged so that a further jet of compressed air is introduced via the control ring, before commencement of a further work cycle so that the receiving holes in the receiving drum are blown clean of any remaining material, to ensure smooth continuous operation of the apparatus.

BRIEF DESCRIPTION OF THE DRAWINGS

The above and other objects and advantages of this invention will be apparent on consideration of the following detailed description, taken in conjunction with the accompanying drawings, in which like reference characters refer to like parts throughout and in which.

DETAILED DESCRIPTION OF THE INVENTION

Figure 1:
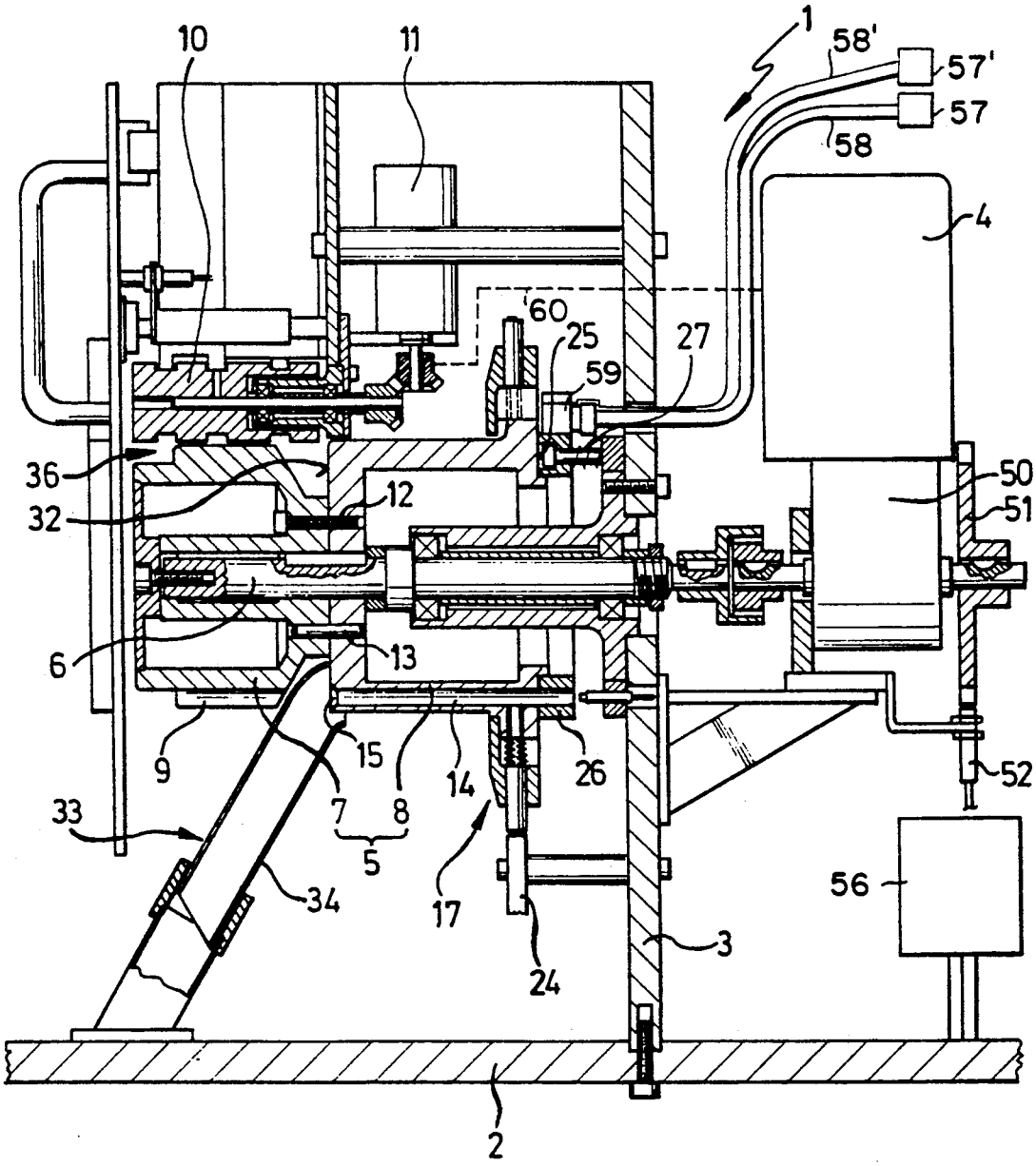
FIG. 1 shows a side view of a section of a basic embodiment of an apparatus for reclaiming tobacco from rejected cigarettes according to the invention.
Figure 1A:
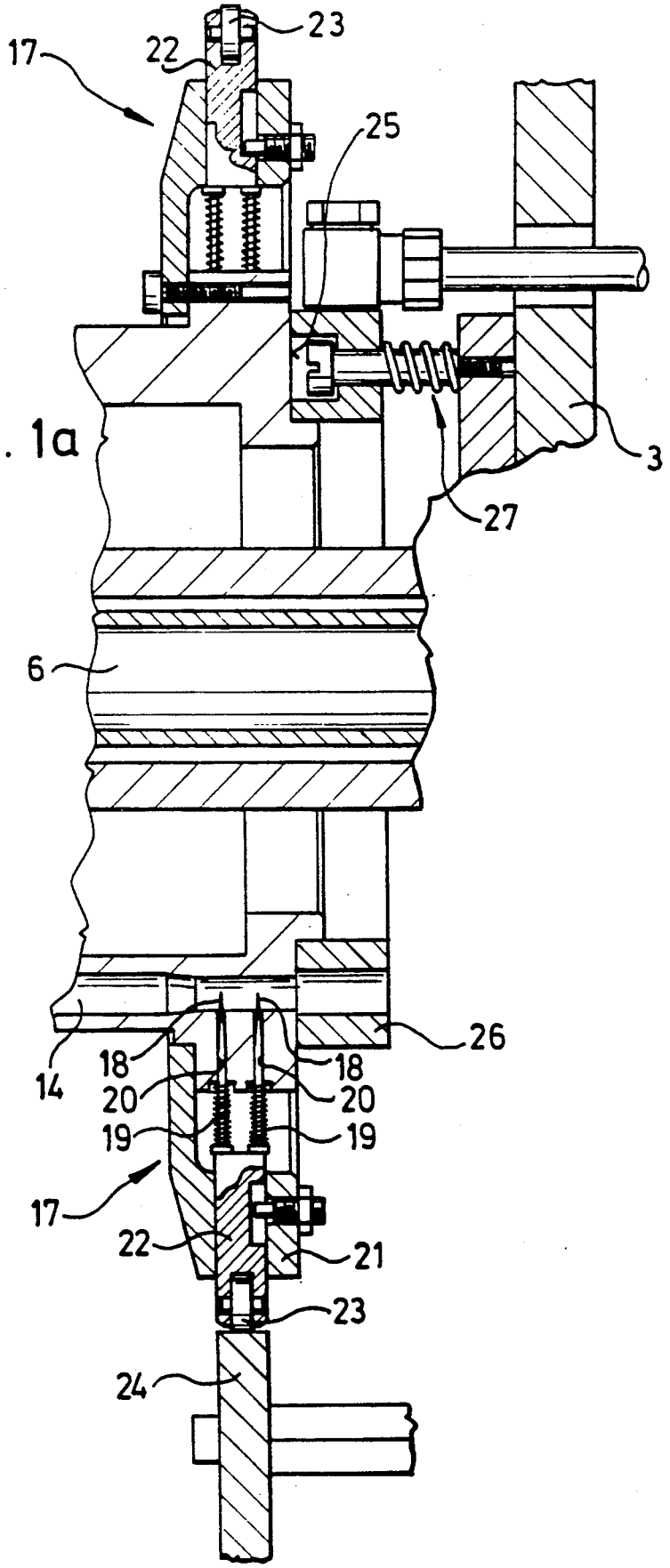
FIG. 1*a* is an enlarged view of the section shown in FIG. 1 to better explain a restraining means.
Figure 2:
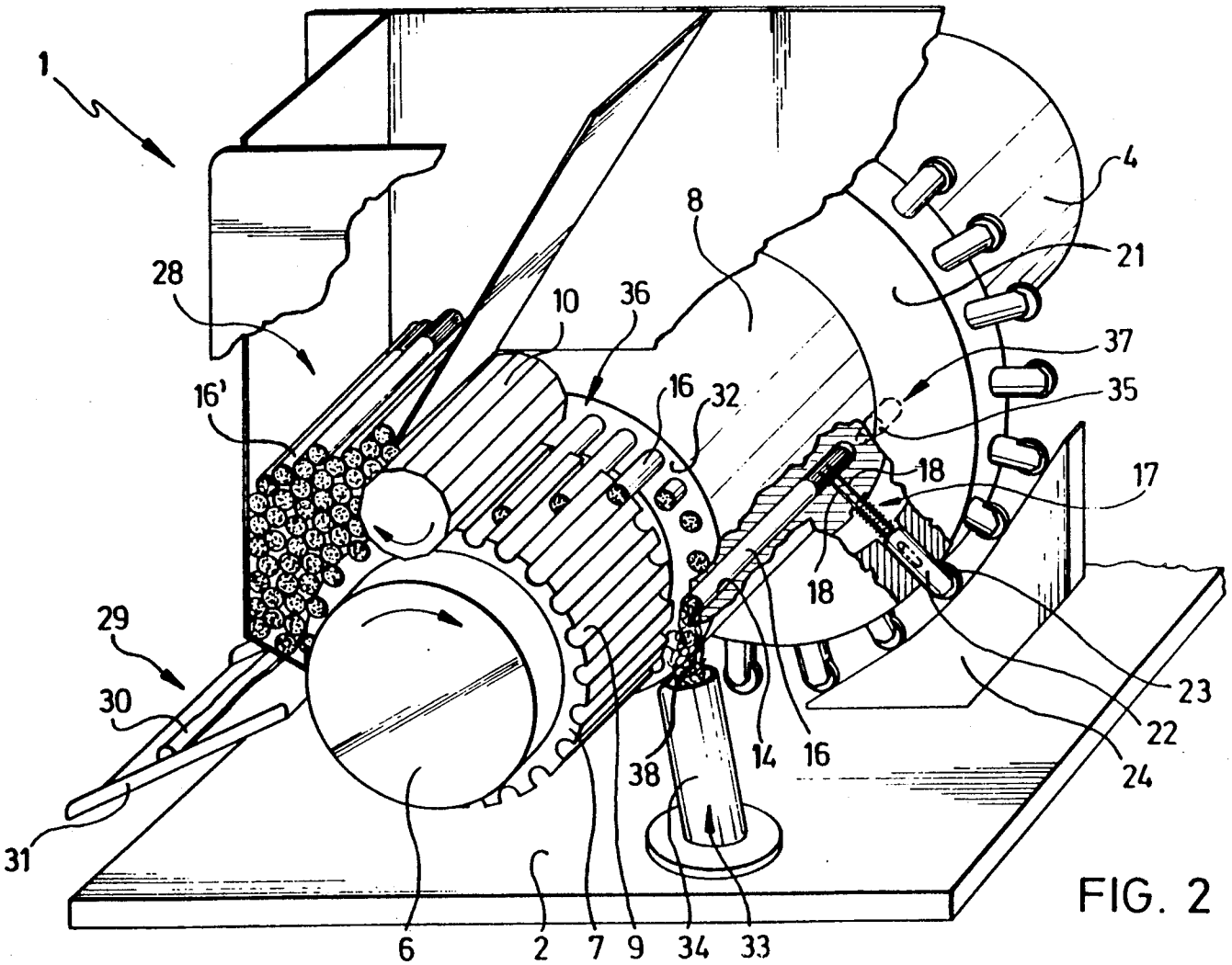
FIG. 2 is a perspective view of a portion of the apparatus shown in FIG. 1.

With reference to FIGS. 1, 1*a* and 2, a preferred embodiment of an apparatus 1 for reclaiming tobacco from rejected cigarettes will now be explained. This apparatus 1 can be designed as a bench or rackmounted unit to be independent of any one particular location. On a base plate 2 oriented substantially horizontally and which can be fabricated in aluminum, for instance, a bearing plate 3 is mounted, oriented substantially vertically. This bearing plate 3 also serves as a wall separating the drive unit and the control unit and the moving parts of the apparatus 1. On the rear side of the bearing plate 3, a drive motor 4 is flange-mounted to drive a combination drum assembly 5 located on the front side of the bearing plate 3. This combination drum assembly 5 comprises a fluted drum 7 and a receiving drum 8 mounted on a common spindle 6. This spindle 6 runs substantially horizontally. The fluted drum 7 has a plurality of flutes 9 regularly spaced around its periphery, this plurality being, for example, 24 in number. Located above the fluted drum 7 is a many-cornered deflection roller 10 running parallel to the axis of the fluted drum 7. This roller 10 is powered by means of a motor 11 to turn so that the surfaces of roller 10 and fluted drum 7 move in opposite directions where they are adjacent one another, as shown by the arrows in FIG. 2. Alternatively, roller 10 may be powered by motor 4 through a suitable linkage 60. The fluted drum 7 is axially fastened to the receiving drum 8, for example, by bolts and pins 12, 13, so that drums 7 and 8 are synchronized to turn in the same direction about common spindle 6. The receiving drum 8 features receiving holes 14 which line up axially with the flutes 9 of the fluted drum 7, these holes extending axially through the receiving drum 8. Guide tapers 15 are provided at the interfaces between the flutes 9 and the holes 14 so that they slope towards the holes 14 for the purpose of compensating for any slight lack of alignment. The receiving holes 14 are of the same number as the flutes 9 on the fluted drum 7. The receiving holes 14 are further dimensioned so that a filter-tipped cigarette 16 can be fully accommodated, as shown in FIG. 2.

The filter tip of each cigarette in a receiving hole 14 is associated with one of restraining means 17, which in the example shown comprise two restraining needles 18 for each receiving hole 14. These restraining needles are preloaded by springs 19 in the direction of their retracted position as shown in FIG. 1. As shown in FIG. 1*a*, the restraining needles 18 pass through corresponding radial openings 20 in the receiving drum 8. The outside of the receiving drum 8 is surrounded by a guide ring 21 secured to the receiving drum 8. With reference to FIG. 1*a* and FIG. 2, pressure or roller pins 22 are arranged free to move radially in guide ring 21, each of these pins carrying a roller 23 at its outer end. The inner end of each roller pin 22 impinges on the restraining needles 18 of the restraining means 17, and each pair of restraining needles 18 is associated with one roller pin 22 in the guide ring 21. For cooperation with the rollers 23 located at the outer ends of the roller pins 22, a cam segment 24 is provided on the base plate 2. The rollers 23 of the roller pins 22 can roll on cam segment 24 to impinge the roller pins 22 so that by means of the roller pins 22, each pair of restraining needles 18 is brought into its restraining position (see FIG. 2). In the restraining position, restraining needles 18 pierce the filter tip of the cigarette 16. On the rear side 25 of the receiving drum 8, a control ring 26 is provided which has slight freedom of axial movement. A spring and pin means 27 ensures that the control ring 26 is in continual contact with the rear side 25 of the receiving drum 8. The control ring 26 will now be explained in detail with reference to FIG. 3.

The hopper 28 containing the rejected cigarettes is arranged slightly above and to one side of the fluted drum 7, the width of the hopper 28 being adjustable to the length of the cigarettes being handled in each case. Beneath the hopper 28, discharge means 29 are provided for discharging the empty cigarette wrappers (tubes) 30. Discharge means 29 comprise a discharge chute 31 for discharging the wrappers (tubes) 30 to a collector (not shown).

On the front face 32 of the receiving drum 8, discharge means 33 are provided for the reclaimed tobacco. Means 33 comprise a length of flexible tubing 34 in contact with the front face 32 of the receiving drum 8 in the area of the receiving holes 14. These means 33 enable the tobacco reclaimed by means of the apparatus 1 to be discharged into a collector (not shown) which is preferably provided beneath the base plate 2 of apparatus 1.

FIG. 2 further shows a sensor 35 for monitoring the presence of cigarettes 16 in the receiving holes 14. This sensor 35 can halt operation of the apparatus 1 when it determines that a cigarette is missing in the receiving hole 14, so that the apparatus 1 can be serviced.

Figure 3:
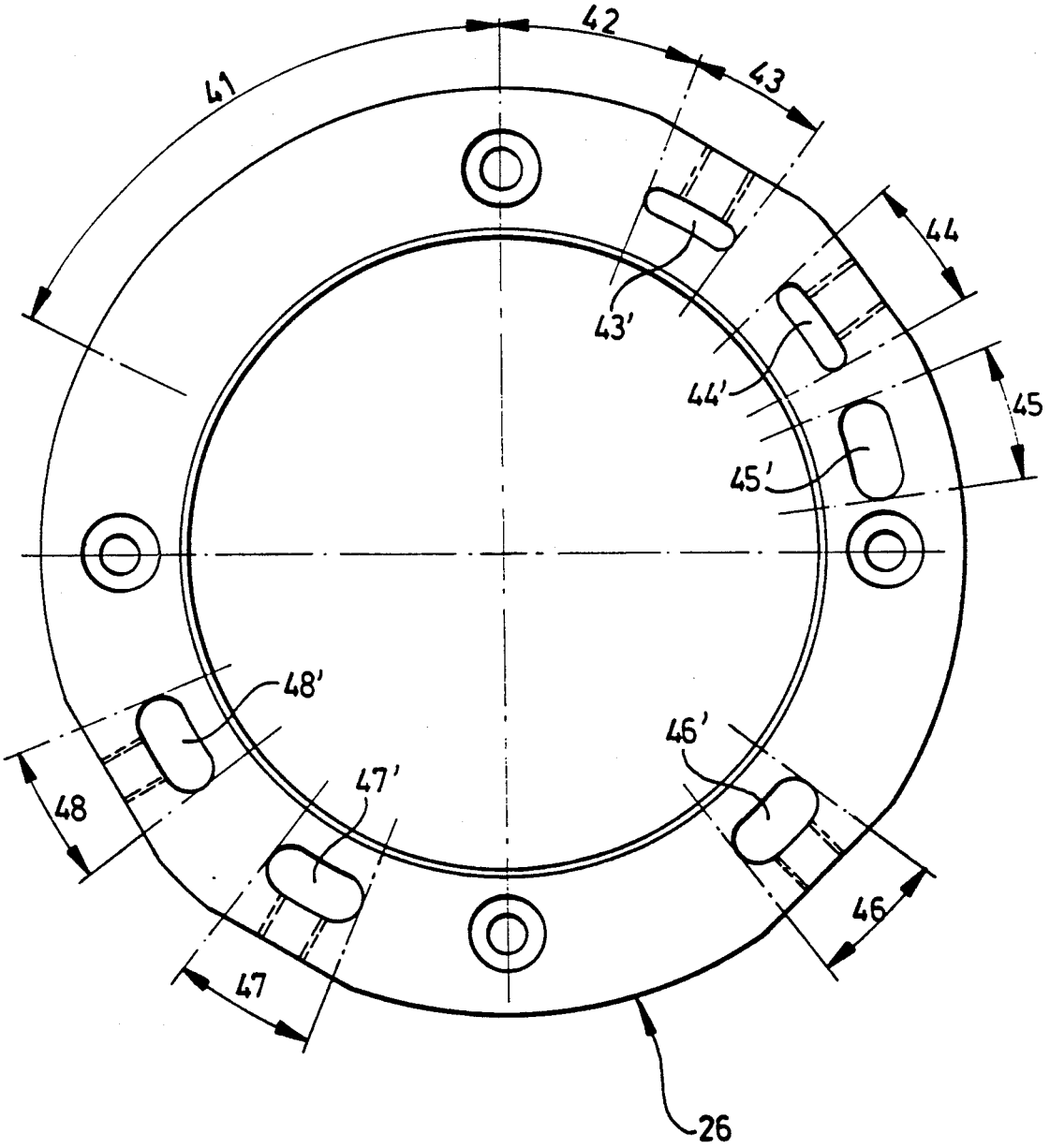
FIG. 3 is a plan view showing details of a control ring of the coordinating control means for the apparatus as shown in FIGS. 1 and 2.

With reference to FIG. 3, further details of the control ring 26 of the apparatus for reclaiming tobacco from rejected cigarettes will now be explained. The control ring 26 is divided into several angular zones serving as control zones. In the example shown, the control ring 26 comprises angular zones 41 through 48. By means of these angular zones, the working sequence of the apparatus 1 is controlled. Control ring 26 constitutes a salient part of the control means for coordinating operation of the apparatus 1 according to the invention.

No opening is provided in the angular zone 41, which serves to commence operation of a work cycle in which the rejected cigarettes 16' drop from the hopper 28 onto the fluted drum 7 and are moved into the flutes with the aid of the single transport means 36 comprising the fluted drum 7 and the many-cornered deflecting roller 10. It should be noted that the depth of the flutes roughly corresponds to the diameter of a cigarette 16'. The cigarettes 16' are further transported clockwise along the periphery of the fluted drum 7. In the region of the angular zone 42, the cigarettes 16' located in the flutes of the fluted drum 7 are moved via the guide tapers 15 towards the receiving holes 14 of the receiving drum 8, so that the filter tip of the cigarette 16' is positioned, for example, 8 mm into the receiving hole 14.

In the region of angular zone 43 an opening 43' is provided, formed preferably by a cardioid-, kidney- or oval-shaped milled cutout. Alternatively, opening 43' may be kidney-shaped or oval-shaped like a racetrack. Via opening 43', suction pressure or vacuum pressure is applied from a source 57, through hose 58 and manifold 59, so that the cigarette 16' partly inserted in the receiving hole 14 is sucked home until its filter-tip is in contact with the control ring, this surface thus functioning as a stop. With the aid of means not shown in the drawing, the intensity of the suction pressure can be adjusted. In the region of angular zone 44 a further cardioid-, kidney- or oval-shaped cutout 44' is provided, also preferably machined by milling, for application of suction pressure. This suction pressure is stronger than that in angular zone 43, thus allowing the vacuum force to be intensified. By means of this intensified vacuum force even heavily deformed cigarettes 16' can be reliably sucked into contact with the control ring 26 through the receiving hole 14.

In the angular zone 45 of the control ring 26, an opening 45' is provided which has the shape of a through-slot. Behind this opening 45' a photoelectric sensing means 37 is provided featuring, for example, sensor 35 in FIG. 2 for detecting the presence of a cigarette 16 in the receiving hole 14 and for counting the cigarettes, if required.

In the angular zone 46 serving as a control zone of the control ring 26, an opening 46' is provided in the form of a cardioid-, kidney- or oval-shaped milled cutout. By means of this opening 46', a connection is made to a compressed air source via hose 58' and manifold 59. Before this compressed air connection is made the cigarette 16 is restrained in the receiving hole 14 with the aid of the restraining means 17. By means of the jet (pulse) of compressed air effective in angular zone 46 and impinging on the filter-tip of the cigarette 16, the tobacco 38 contained in the wrapper (tube) 30 of the cigarette is ejected into the assigned collector. With the aid of the spring and pin means 27 shown in FIG. 1, the control ring 26, especially in the region of this angular zone 46, is forced against the rear face 25 of the receiving drum 8 by means of a single-acting short-stroke cylinder, to counteract the increased ejection pressure, so that the control ring 26 cannot lift away from the rear side 25 of the receiving drum 8.

Angular zone 46 is followed by an angular region having no openings or the like which when traversed by further turning of the control ring causes the restraining means 17 to be retracted to its original position so that the empty cigarette wrapper (tube) 30 now is released in the receiving hole 14.

In angular zone 47, an opening 47' is provided which is cardioid-, kidney- or oval-shaped and connected to compressed air impinging means. By means of this connection, compressed air is jetted into the receiving hole 14 so that the empty wrapper 30, which may feature a filter tip, is ejected from the receiving hole 14 and transported to the associated discharge means 29.

In a further angular zone 48, an opening 48' is provided which is cardioid-, kidney- or oval-shaped and which is also connected to the compressed air impinging means. Through this opening 48', located in the angular zone 48, compressed air impingement means may be connected to blow out any tobacco remainders or wrapper debris 30 thus preventing blocking of the receiving holes 14 which could result in malfunction of the apparatus 1.

Figure 4:
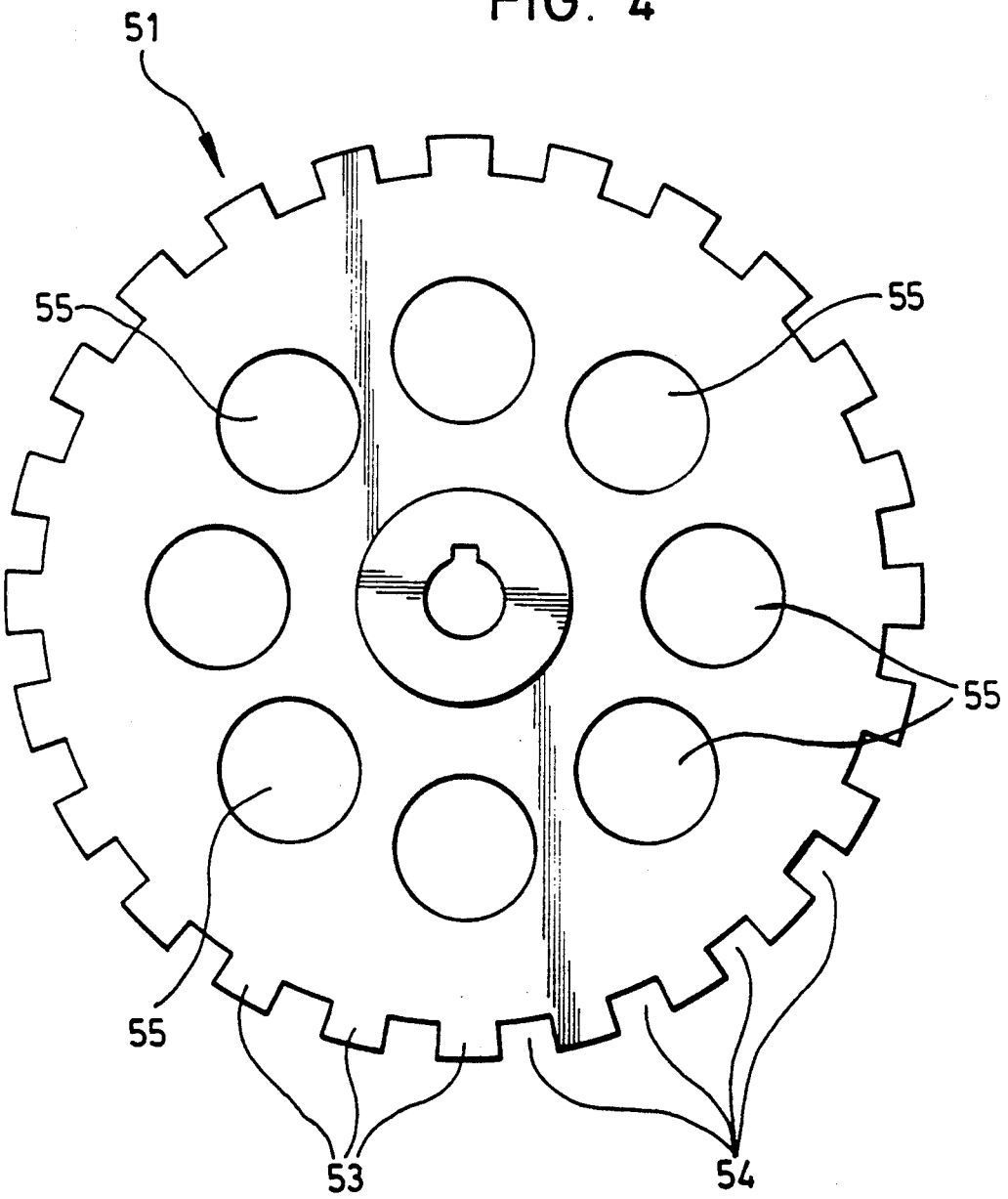
FIG. 4 is a plan view of a timing disc of the coordinating control means of the apparatus.

As can be seen from FIG. 1, the drive motor 4 for powering the fluted drum 7 and receiving drum 8 located on the spindle 6 is provided axially spaced away on the end of the shaft 6 located behind the bearing plate 3. The drive motor 4 has assigned a tachogenerator 50, which operates together with the spindle 6 to control the speed of the spindle 6. A timing disc 51 is also mounted on spindle 6 located behind the tachogenerator 50 as shown in FIG. 1 when viewed to the right, where it is provided for adjustment. The timing disc 51, shown in more detail in FIG. 4 operates together with a proximity switch 52 and coordinating control means 56, to determine the precise cycle timing of the apparatus 1. The timing disc 51 features a regular arrangement of alternating tooth-shaped projections 53 and slots 54 around its periphery. The proximity switch provides a signal which indicates whether a tooth-shaped projection 53 or a slot 54 is adjacent to the proximity switch. The proximity switch, therefore provides a timing signal directly responsive to the rotation of the timing disc 51. The timing disc 51 is also provided with a circular arrangement of holes 55 concentric to the center line of the shaft 6, these holes being arranged in regular angular spacings and all having the same size. In the example shown eight such holes 55 are provided.

Apparatus 1 illustrated in FIGS. 1–4 is operated in accordance with a further embodiment of the invention as described more detailed in the following. This method of operation is, of course, a preferred procedure for operating the apparatus and as will be apparent to those skilled in the art, a wealth of modifications can be made regarding the working sequence without departing from the spirit of the invention.

The principal components, in the apparatus 1 according to the invention, are coordinating control means 56, the timing disc 51 as explained above, the associated proximity switch 52, the control ring 26 and the cam segment 24 by means of which the pressure pins 22 in the guide ring 21 are impinged. The single transport means 36 comprises the fluted drum 7 and the many-cornered deflection roller 10 working together with the drum 7. In the method of operation according to the invention, the filter cigarettes 16' in the hopper 28 for rejected cigarettes are transferred one by one into the correspondingly shaped flutes 9 in the fluted drum 7 with the aid of the many-cornered deflecting roller 10 and the fluted drum 7 of the single transport means 36. During rotary movement of the fluted drum 7 in the direction of the arrow as shown in FIG. 2 the filter cigarettes 16' are transported, one by one, in the flutes 9 in the direction of the periphery. After a predetermined time dictated by the angular range of the angular zone 41 of the control ring 26, each filter cigarette 16' is introduced one by one a small distance into the receiving holes 14 of the receiving drum 8 from the flutes 9 of the fluted drum 7. Via the opening 43' in the angular zone 43 of the control ring 26, a vacuum or suction pressure is applied to the receiving holes 14, so that each cigarette 16 is sucked into a corresponding receiving hole 14. Via the opening 44' in the angular zone 44 of the control ring 26, an even stronger suction pressure can be applied so that heavily deformed cigarettes 16 can be sucked into each receiving hole 14 until its filter tip is in contact with the face of the control ring 26 facing the receiving drum 8. Via the cam segment 24 applying pressure to the rollers 23 of the roll pins 22, the restraining needles 18 are forced to pierce the filter tip of the cigarette 16 preferably at two axially spaced positions via the radial openings 20, the cigarette then being located in the receiving hole 14. While this happens, the opening 45' in the angular zone 45 of the control ring 26 and the sensor 35 are used to establish whether a cigarette 16 is present in the receiving hole 14 or not. When the result is positive, combination drum assembly 5, including fluted drum 7 and receiving drum 8, rotates further relative to control ring 26, and via the opening 46' in the angular zone 46 a jet of compressed air is aimed in axial direction at the receiving hole 14 where it expels the tobacco from the cigarette 16 held in place by the restraining means 17 to the corresponding discharge means 33. In further turning of the two drums 7 and 8 and the connected guide ring 21, the rollers 23 are released from the cam segment 24 and the restraining needles 18 are, in turn, introduced into the radial opening 20 in the receiving drum 8 with the aid of the return springs 19, thus releasing the cigarette wrapper (tube) 30 which is now empty. Via the opening 47' in the angular zone 47 of the control ring 26, a new jet of compressed air is applied, by means of which the empty cigarette wrapper (tube) 30 is ejected from the receiving hole 14 and transported to the discharge means 29 for the wrappers 30. Via the chute 31 of the discharge means 29, the empty wrapper 30 is transported to a collector (not shown in the drawing) suitable for collecting the empty cigarette wrappers (tubes) 30.

In further partial rotary movement of combination drum assembly 5 relative to control ring 26, a further jet of compressed air is applied via an opening 48' in the angular zone 48 of the control ring 26 to blow the receiving hole 14 clean of any remaining tobacco debris.

This last phase of the aforementioned working phases completes the work cycle, and the drums 7 and 8 relation to control ring 26 have then rotated full circle, i.e., 360° about the center-line of the spindle 6. The coordinating control means 56 then implements a further such work cycle.

As indicated by the above description, apparatus 1 according to the invention permits non-stop reclaiming of tobacco from rejected cigarettes by means of a fully automatic work cycle thus enabling the apparatus 1 to quickly and reliably reclaim the tobacco from rejected cigarettes, which following suitable intermediate treatment can then again be used in cigarette production. Tests have shown that with the aid of the apparatus 1 according to the invention roughly 12 seconds are required to reclaim the tobacco from approximately 100 cigarettes and, separately, to collect the empty cigarette wrappers (tubes). The apparatus also permits non-destructive separation of the wrapper 30 and the proportionate amount of tobacco thus achieving reliable inspection of the necessary product quality which, in turn, enables the quality requirements to be safeguarded and significantly improved.

It will be readily understood that the invention is not limited to the above details, neither as regards its aspects as a device nor as a method, but that various changes and modifications are possible which the person skilled in the art will implement as required without departing from the gist of the invention, as long as the steps in the achievement of the invention are realized. For instance, microprocessor control systems and the like can be used to achieve more speedy and reliable handling of the data and signals essential to control of the work cycle.

What is claimed is:

1. Apparatus for reclaiming tobacco from rejected cigarettes, each cigarette having a wrapper and two ends, the apparatus comprising:

a) a hopper for the rejected cigarettes;

b) means for transporting the cigarettes comprising a fluted drum rotatable about a center axis and having a plurality of fluted depressions regularly distributed about its periphery;

c) means for restraining single cigarettes;

d) means for applying a jet of compressed air to expel the tobacco from each restrained cigarette;

e) a first collector means for receiving the ejected tobacco and a second collector means to receive the cigarette wrappers;

f) a receiving drum having receiving holes axially aligned with the flutes in the fluted drum the receiving drum having a front face and a rear face, the front face facing the fluted drum and the rear face facing away from the fluted drum, the receiving drum coupled to the fluted drum so that the drums rotate together about the center axis; and g) suction means for moving each cigarette singly from the fluted drum into the corresponding receiving hole so that one end of the cigarette is positioned in an area of the receiving hole near the rear of the receiving drum; wherein:

h) the restraining means comprises at least one restraining needle per receiving hole, the needle being radially moveable with respect to the center axis so that the needle can move into engagement with the end of the cigarette in the receiving hole; and the apparatus further comprises:

i) coordinating control means comprising the control ring axially extending from the receiving drum and divided into predetermined angular zones for applying one of (1) positive air pressure, and (2) negative air pressure, in accordance with a working sequence of the apparatus.

2. Apparatus according to claim 1, wherein the restraining means comprises two axially spaced restraining needles per receiving hole.

3. Apparatus according to claim 1, further comprising:

a guide ring surrounding and connected to the receiving drum for urging the at least one restraining needle in the direction of the restraining position; and for each of the at least one restraining needle, a pressure impacting pin radially moveable within the guide ring.

4. Apparatus according to claim 3, comprising a cam control for impacting the pressure pin for engaging the at least one restraining needle, and for holding the at least one restraining needle in the restraining position while the cigarettes are blown clean by means of compressed air.

5. Apparatus according to claim 1, wherein:

the control ring is spring-biased in the axial direction toward the rear face of the receiving drum, and is in contact with the rear face of the receiving drum; and the control ring provides stop means to determine the insertion depth of the cigarettes in the receiving holes.

6. Apparatus according to claim 1, wherein:

the fluted drum and the receiving drum form a combination drum assembly;

during one complete revolution of the combination drum assembly, the combination drum assembly passes through at least one predetermined angular zone of the control ring for application of a suction pressure for moving the cigarettes into the receiving holes, and through at least one angular zone for introducing a jet of compressed air to expel the tobacco from the cigarette wrappers in the receiving holes.

7. Apparatus according to claim 6, wherein the combination drum assembly passes through a further angular zone of the control ring, the further angular zone serving as a control zone for applying a jet of compressed air to eject the empty cigarette wrappers.

8. Apparatus according to claim 6 or claim 7, wherein openings are provided in the control zone and the predetermined angular zone so that a connection can be made to one of the compressed air jetting means and the source of suction pressure.

9. Apparatus according to claim 1, wherein the fluted drum and the receiving drum are mounted on a common spindle.

10. Apparatus according to claim 9, wherein the control ring is mounted on the common spindle.

11. Apparatus according to claim 1, further comprising guide tapers at the interface between each flute of the fluted drum and each receiving hole in the receiving drum, the guide tapers sloping towards the receiving holes.

12. Apparatus according to claim 1, further comprising a many-cornered deflecting roller having an axis parallel to the center axis of the fluted drum, for cooperating with the fluted drum to isolate the rejected cigarettes.

13. Apparatus according to claim 12, wherein the many cornered deflecting roller turns in the same direction as the fluted drum.

14. Apparatus according to claim 13, wherein the fluted drum, the receiving drum and the many-cornered deflecting roller are powered by a single drive means.

15. Apparatus according to claim 1, wherein the cigarette has a filter tip.

16. Apparatus according to claim 1, further comprising a sensor for detecting the presence of a cigarette in the receiving hole and halting operation of the apparatus when a cigarette is missing from a receiving hole.

17. An apparatus according to claim 1, further comprising photoelectric detector means for simultaneously detecting and counting the cigarettes.

18. A method for operating the apparatus according to claim 7, comprising the steps of:

transporting the rejected cigarettes one by one from the hopper into corresponding flutes of the fluted drum;

further transporting the cigarettes by means of the rotary movement of the fluted drum;

transferring the cigarette from the flutes of the fluted drum into the receiving holes of the receiving drum by means of applied suction pressure, so that the end of the cigarette is in contact with the face of the control ring;

impacting a pressure pin with a cam control means so that the pressure pin urges the at least one restraining needle to pierce the end of the cigarette;

applying a jet of compressed air into the receiving hole by means of the coordinating control means so that the tobacco is expelled from the cigarette wrapper;

collecting the expelled tobacco in the first collector means;

disengaging the pressure pin so that the at least one restraining needle disengages form the cigarette wrapper;

applying a jet of compressed air into the receiving hole by means of the coordinating control means, to eject the wrapper;

collecting the wrapper in the second collector means; and controlling the working sequence by a coordinating control means comprising a timing disk, a control ring, a guide ring and the cam control means.

19. A method according to claim 18 further comprising blowing the receiving holes of the receiving drum clean of any remaining tobacco debris with a new jet of compressed air from the control ring, prior to commencement of a new work cycle.

20. Apparatus according to claim 12 or claim 13, wherein the fluted drum and the receiving drum are powered by a first drive means and the many-cornered deflecting roller is powered by a second drive means.

* * * * *